US007025835B2

(12) United States Patent
Pedlar et al.

(10) Patent No.: US 7,025,835 B2
(45) Date of Patent: Apr. 11, 2006

(54) SCRUBBING MACHINE PASSIVE RECYCLING

(75) Inventors: Roger Pedlar, Golden, CO (US); Eric Shark, Littleton, CO (US); Loi Tran, Highlands Ranch, CO (US); Robert Gorsky, Highlands Ranch, CO (US); Todd Tuinier, Englewood, CO (US); Rex Shull, Parker, CO (US); Cynthia Page, Littleton, CO (US); Nevin Green, Littleton, CO (US); Erik Ring, Sharon, MA (US); Craig Rissler, Littleton, CO (US); Timothy Nunez, Thorton, CO (US)

(73) Assignee: Castle Rock Industries, Englewood, CO (US)

( * ) Notice: Subject to any disclaimer, the term of this patent is extended or adjusted under 35 U.S.C. 154(b) by 406 days.

(21) Appl. No.: 10/269,146

(22) Filed: Oct. 11, 2002

(65) Prior Publication Data

US 2003/0070252 A1 Apr. 17, 2003

Related U.S. Application Data

(60) Provisional application No. 60/329,260, filed on Oct. 12, 2001.

(51) Int. Cl.
*A47L 11/30* (2006.01)
*E01H 1/08* (2006.01)

(52) U.S. Cl. ..... 134/21; 15/320; 15/323

(58) Field of Classification Search ..... 15/320, 15/323, 340.1, 340.2, 340.3, 340.4, 385, 15/401, 402; 134/6, 21

See application file for complete search history.

(56) References Cited

U.S. PATENT DOCUMENTS

| | | | | |
|---|---|---|---|---|
| 1,695,246 A | | 12/1928 | Gammeter | |
| 2,893,048 A | | 7/1959 | Martinec | 15/422 |
| 2,981,966 A | | 5/1961 | Beffel | 15/246 |
| 3,010,135 A | | 11/1961 | Pollnow, Jr. | 15/246 |
| 3,011,191 A | | 12/1961 | Hulsh | 15/49 |
| 3,019,465 A | | 2/1962 | Bayless | 15/180 |
| 3,122,769 A | | 3/1964 | Doersam | 15/246 |
| 3,153,251 A | | 10/1964 | Ohlson | 15/50 |
| 3,277,511 A | * | 10/1966 | Little et al. | 15/320 |
| 3,436,788 A | | 4/1969 | Tamny | 15/340 |
| 3,733,635 A | | 5/1973 | Carden | 15/49 |
| 3,908,220 A | | 9/1975 | Adamson et al. | 15/50 |
| 4,178,654 A | * | 12/1979 | Mitchell | 15/385 |

(Continued)

FOREIGN PATENT DOCUMENTS

DE 1628617 * 7/1975

*Primary Examiner*—Terrence R. Till
(74) *Attorney, Agent, or Firm*—Sheridan Ross P.C.

(57) ABSTRACT

A floor cleaning machine has one or more barriers immediately behind one or more scrubbing brushes, wherein the barriers capture and control flow of a cleaning solution (and/or other substances) that exits from beneath the scrubbing brush(es) so that such a solution is retained adjacent the scrub brush(es) and recycled underneath the scrub brush(es) for enhancing the floor cleaning effectiveness of the floor cleaning machine. The captured solution is urged back into contact with the scrubbing brush(es) by the same rotating action that urged the solution to be ejected from the scrubbing brush(es). The machine also includes at least one splash guard and a squeegee mounted at the rear of the machine, with each of these latter components serving distinctly different functions from that of the barriers. The machine may also include an exterior top storage area for retaining various items that are useful in cleaning the floor.

19 Claims, 9 Drawing Sheets

U.S. PATENT DOCUMENTS

| | | | | |
|---|---|---|---|---|
| 4,492,002 | A | 1/1985 | Waldhauser et al. | 15/320 |
| 4,510,643 | A | 4/1985 | Kitada | 15/320 |
| 4,731,956 | A * | 3/1988 | Wood | 451/353 |
| 4,805,256 | A * | 2/1989 | Mason et al. | 15/320 |
| 5,280,663 | A | 1/1994 | Proulx | 15/246 |
| 5,513,413 | A | 5/1996 | Myers et al. | 15/246 |
| 5,579,555 | A | 12/1996 | Pearse | 15/320 |
| 5,613,270 | A | 3/1997 | Alvarez et al. | 15/320 |
| 5,615,437 | A * | 4/1997 | Takahashi et al. | 15/98 |
| 5,940,928 | A * | 8/1999 | Erko | 15/319 |
| RE36,565 | E | 2/2000 | Burgoon et al. | 15/320 |
| 6,108,859 | A | 8/2000 | Burgoon | 15/320 |
| 6,163,923 | A | 12/2000 | Hefter | 15/340.4 |
| 6,189,755 | B1 * | 2/2001 | Wakefield | 224/542 |
| 6,249,926 | B1 | 6/2001 | Wulff | 15/50.1 |
| 6,530,117 | B1 * | 3/2003 | Peterson | 15/353 |

* cited by examiner

SCRUBBING MACHINE PASSIVE RECYCLING

RELATED APPLICATION

The present application claims priority from prior U.S. Provisional Patent Application No. 60/329,260, filed Oct. 12, 2001, which is fully incorporated herein by reference.

FIELD OF THE INVENTION

This invention relates to a floor cleaning machine for scrubbing floors and, in particular, to controlling the containment of a liquid cleaning solution and/or other materials, such as debris, during the scrubbing process in order to continue or enhance use of cleaning solution over a greater floor surface.

BACKGROUND OF THE INVENTION

Of the various types of floor cleaning machines that have been developed, the expeditious use and reuse of a cleaning solution remains important to efficient cleaning or scrubbing of floors. In particular, many floor cleaning machines have rotary scrubbing brushes that rotate about a substantially vertical axis when scrubbing a floor. Accordingly, such rotary motion tends to eject the cleaning solution away from where the scrubbing brushes contact the floor. Thus, the cleaning solution must be constantly applied to the floor surface at a rate at least sufficient to replenish the cleaning solution at the scrub brush(es) that has been ejected by the centrifugal forces induced by the rotary motion of the brush(es). Accordingly, it would be advantageous to have a cleaning machine that retains the cleaning solution a longer time period within proximity of the scrubbing brush(es) so that the cleaning solution does not have to be applied to the floor surface at as high a rate, and/or there is a greater amount of cleaning solution available under or about the scrubbing brush(es), thus providing for better floor cleaning. Additionally, it would be advantageous to be able to recirculate the cleaning solution on the floor surface such that when it is ejected from the scrubbing brush(es), a substantial amount of ejected solution is channeled along a flow path that leads this ejected solution back under the scrubbing brush(es). More particularly, it would be advantageous for the ejected cleaning solution to be channeled or pooled just behind the scrubbing brush cleaning assembly in a manner such that the same rotary action of scrubbing brush(es) causes this channeled or pooled cleaning solution to move toward the front of the scrubbing brush cleaning assembly, and thus once again come in operational contact with the scrubbing brush(es).

SUMMARY OF THE INVENTION

The floor cleaning machine can be any number of differently configured scrubbing apparatuses including a rider machine or a walk behind machine with the scrubbing assembly located beneath or forward of the cleaning machine body, or any other scrubbing machine with a body or handle for engagement by the operator. Regardless of the machine's configuration, each of them has at least a first barrier for use in containing materials within the area serviced by the scrubbing assembly for a relatively longer period of time by preventing or substantially preventing the escape of liquid from the rear of the scrubbing assembly. In addition to the rear, the scrubbing assembly has a front. The front of the scrubbing assembly leads the scrubbing assembly over the floor during the floor scrubbing operation when the machine is moved in a forward direction, in contrast to movement of the machine in a reverse direction.

In one embodiment, the scrubbing assembly has at least a first scrubbing brush with a circumference that has a circumferential portion that is less than the circumference. For example, the circumferential portion may be between about 90° and about 270°. The first barrier has portions that are disposed radially outwardly of this circumferential portion.

One or more embodiments can also include a skirt or splash guard. The skirt is located outwardly of both the scrubbing assembly and the first barrier. The skirt has utility in substantially preventing or at least reducing unwanted splash that may occur during the operation of the floor cleaning machine.

Each of the embodiments also preferably has a squeegee assembly that is located behind the scrubbing assembly in the context of movement of the floor cleaning machine when it is scrubbing a floor. Whenever the floor cleaning machine includes such a squeegee assembly, the first barrier is located closer to the first scrubbing brush than it is to the squeegee assembly.

Based on the foregoing summary, a number of salient aspects of the present invention are readily noted. One or more barriers is provided that maintain solution for use by a scrubbing assembly for a longer period of time. Preferably, each barrier does not completely surround the associated brush of the scrubbing assembly, but is open at its front and closed at its rear. In one or more embodiments, the floor cleaning machine can include a skirt, in addition to the one or more barriers, for use in controlling any splash. The floor cleaning machine of the present invention can also include a squeegee assembly that is useful in picking up solution after the scrubbing assembly is finished with it scrubbing function. The squeegee assembly has preferred positioning relative to the one or more scrubbing brushes of the scrubbing assembly.

Other advantages and benefits of the present invention will become evident from the accompanying drawings and the descriptions of the inventive features set out hereinbelow.

DETAILED DESCRIPTION

Figure 1:
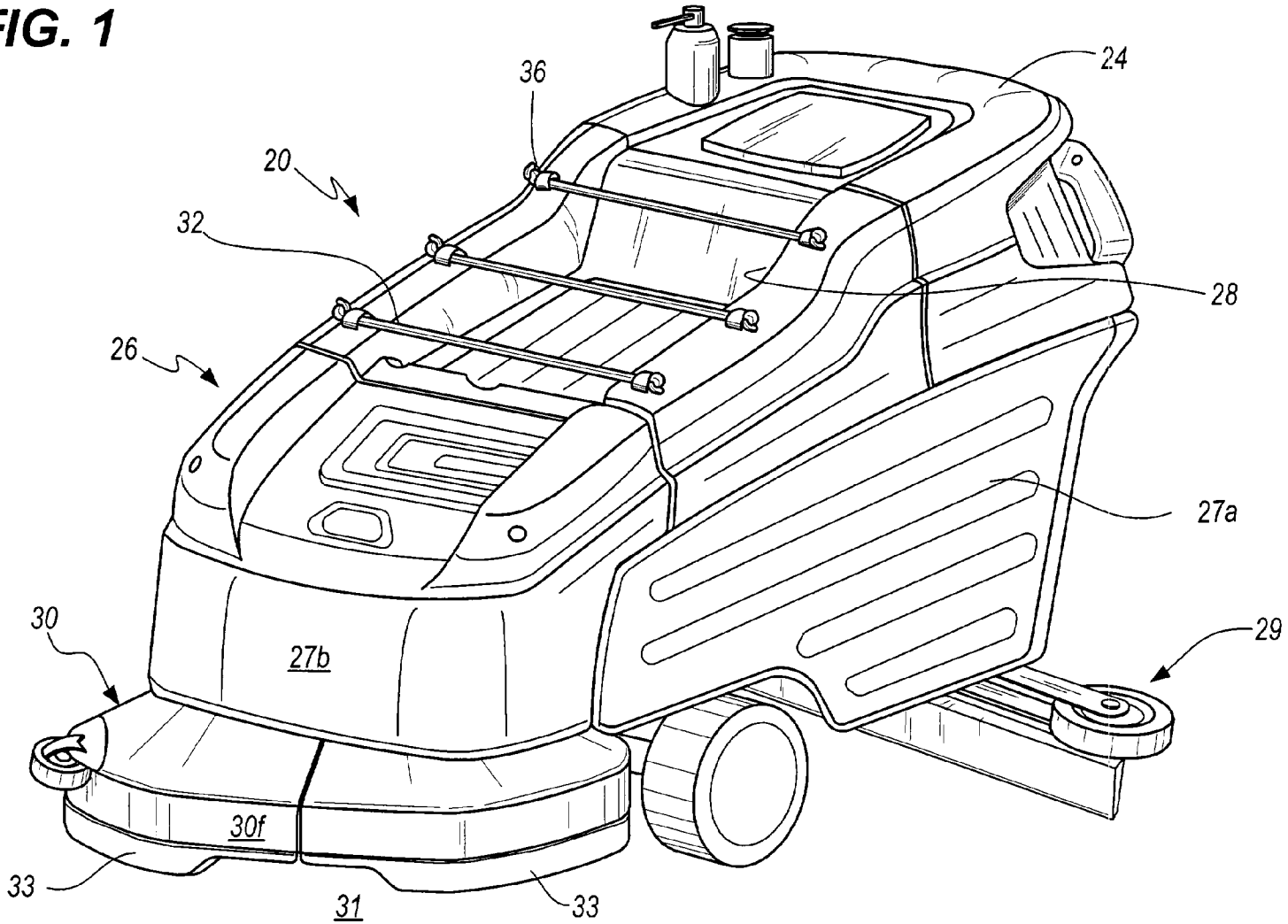
FIG. 1 is a perspective exterior view of a cleaning machine 20 according to the present invention. Note that FIG. 1 shows a cavity 28 that provides storage for carrying various items used in cleaning a floor surface.

With reference to FIG. 1, one embodiment of a floor cleaning machine 20 includes a body or housing 24 that is part of a walk behind floor cleaning machine which is moved under power activated by the operator who controls machine operation. The body 24 includes a main assembly 26 of the floor cleaning machine, wherein the main assembly includes at least the exterior side panels 27*a,* and front panel(s) 27*b* as well as a supporting frame (not shown). and to which a scrubbing assembly 30 is joined at one or more lower portions of the body 24. The scrubbing assembly 30 has a front 30*f* which extends generally forwardly from the front panel(s) 27*b,* and thus this front 30*f* leads the main assembly 26 during forward motion of the machine 20. The front 30*f* of the scrubbing assembly 30 has a lower portion 33 that serves as splash guard about the front of the machine 20, thereby reducing and preferably preventing the cleaning solution (more generally, floor application substance) from an airborne exit from the scrubbing assembly 30 along the extent of the splash guard 33. Note that the splash guard 33 is substantially adjacent to floor surface 31 about the front of the machine 20, and further extends at least partially about the sides of the machine 20. The scrubbing assembly rear 30*r* (FIGS. 4 and 5) is generally underneath the main assembly 26. The scrubbing assembly 30 includes:

(a) at least one scrubbing brush (not shown in FIG. 1, but one of which is labeled 64 in FIG. 4) positioned within the scrubbing assembly 30 for rotationally contacting the floor surface 31, (b) at least one brush motor (not shown in FIG. 1, but one of which is labeled 88 in FIG. 4) for rotating the at least one scrubbing brush, and (c) a frame assembly (also not shown in FIG. 1, but an embodiment of which is labeled 69 in FIG. 4) upon which the at least one brush motor is operably attached.

Figure 7:
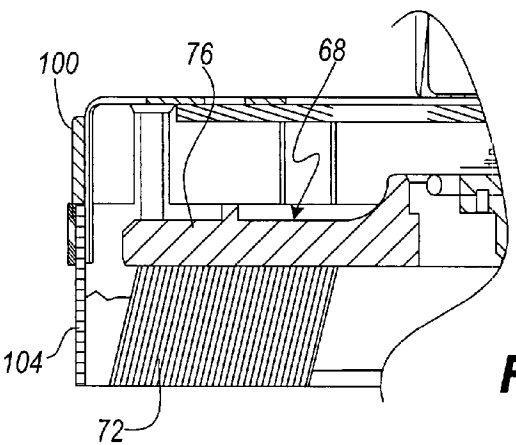
FIG. 7 shows a magnified view of a portion of FIG. 6 thereby providing greater detail of some of the scrubbing assembly 30 components.

Note that such a scrubbing brush may usually be comprised of a number plurality of bristles connected to a disk shaped head or base member (not shown in FIG. 1, but one of which is labeled 72 in FIG. 7). The ends of the scrubbing brush bristles scrub the floor surface 31 during the cleaning process.

Positioned at the rear of the machine 20 is a squeegee assembly 29 for extracting excess and/or spent cleaning solution (more generally, a surface application substance or solution) from the floor surface 31. Note that the squeegee assembly 29 may extend outwardly beyond the side panels 27*a* so as to capture the surface application substance or solution that escapes from underneath the machine 20.

In one embodiment, the machine body 24 includes a cavity or recess 28 of a desired size to accommodate and hold any one or a number of items that may be useful related to cleaning operations. The cavity 28 illustrated in FIG. 1 is generally centered along the top or upper portions of the body 24 between its front and rear ends and its two side walls. These upper portions can be defined as having a total outer surface area. The outer surface area of the cavity or cavities 28 is at least about 10 percent of the total outer surface area of the upper portions. In another embodiment, the outer surface area of the cavity or cavities 28 can be at least about 15 percent and, in yet another embodiment, the outer surface area of the cavity or cavities 28 can be at least about 20 percent. In the embodiment of FIG. 1, although it may not be necessary, a containment structure may be utilized to secure the one or more items in the cavity 28. The containment structure might include one or more straps or cords 32, which can have elastic or resilient properties, that extend laterally (and/or could extend longitudinally) relative to the machine body 24. The straps 32 are held to the body 24 adjacent to the edges of the cavity 28 using holding mechanisms 36, such as hooks, eyelets or fasteners, such as rivets, screws, bolts or the like, which may be fixed or removable. The number of straps 32 can vary and may depend on the size of the items that are to be held within the cavity 28. As can be understood, other containment structures can be utilized including a single cover piece or a mesh, which could be made of a flexible material or relatively rigid material. Regardless of the physical characteristics of the containment structure, the portions thereof are positionable to permit access to the cavity 28 in order to place the one or more items within the cavity. After doing so, the containment structure is positioned to hold such items within the cavity 28, such as during transport or movement of the machine 20.

Figure 2:
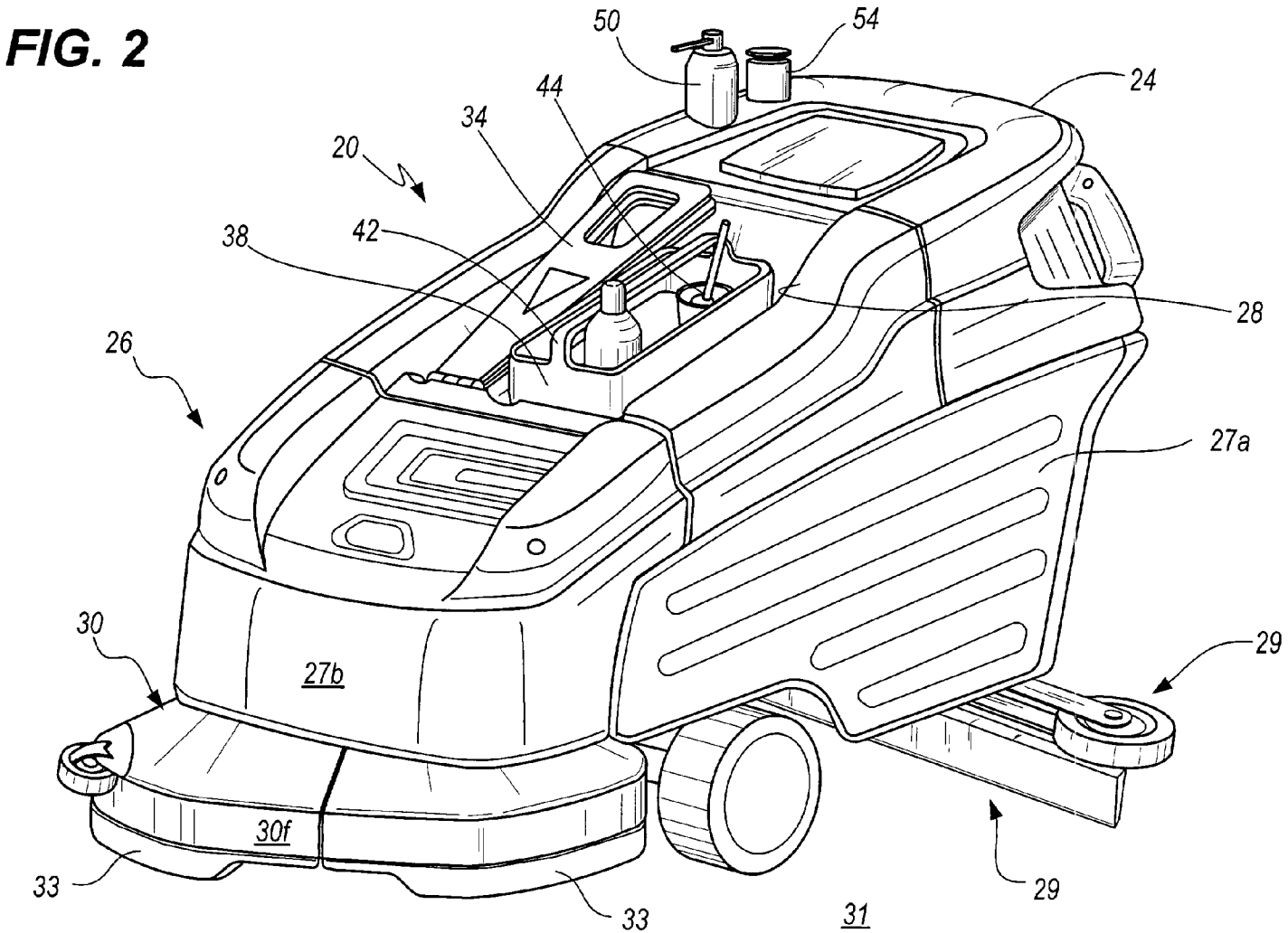
FIG. 2 is a perspective view of an alternative embodiment of a cleaning machine 20, wherein the cavity 28 does not have holding mechanisms 36 (FIG. 1) for retaining items in the cavity.
Figure 3:
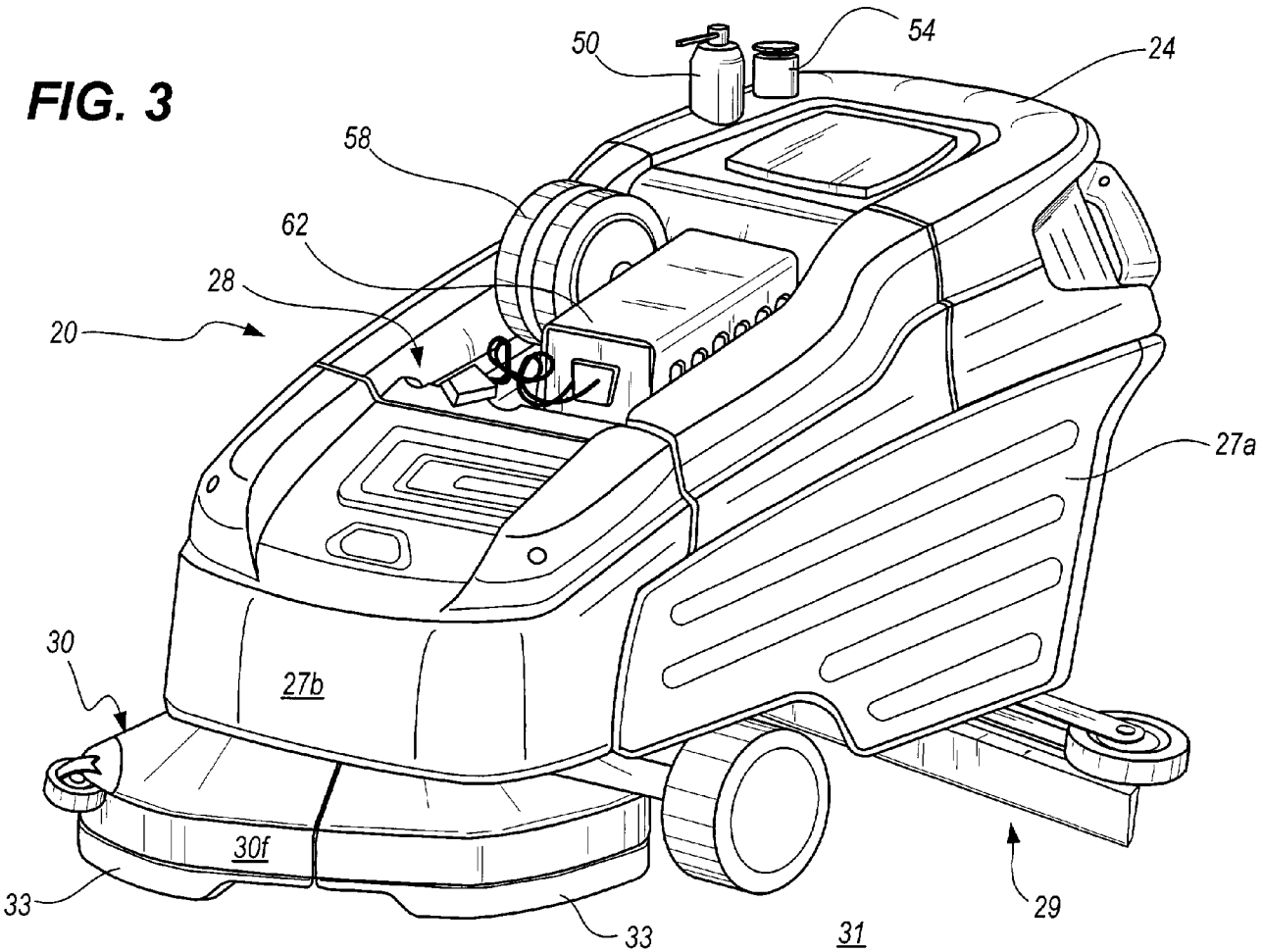
FIG. 3 is another perspective view of the cleaning machine 20 shown in FIG. 2, wherein a different assortment of items are shown residing in the cavity 28.

Referring to FIGS. 2 and 3, representative examples of items that can be positioned and held in the cavity 28 are illustrated. As seen in FIG. 2, a sign or other indicator 34 useful in notifying or warning others that a particular section of floor is being cleaned can be transported using the cavity 28. The sign 34 can be subsequently set up by the operator at a desired location. The cavity 28 can also hold a container or bucket 38. The container 38 can itself contain a number of separate cleaning utensils or articles, such as a liquid cleaning container 42 and a hand brush 44. In addition to the cavity 28, located adjacent the back of the body 24 of the machine 20, wells or recesses can be formed therein for holding items, such as a spray bottle 50 and/or a drinking cup 54. Referring to FIG. 3, the cavity 28 has a size sufficient to hold spare cleaning components, such as brushes 58. The dimensions of the cavity 28 are even of a size to hold a relatively large battery charging unit 62. The battery charging unit 62 can be used to charge the batteries that power the cleaning machine 20. As can be appreciated, the cavity 28 can be part of cleaning machines other than a walk behind scrubbing machine. The structure and associated feature of the cavity 28 can be implemented or otherwise included with a variety of relatively larger cleaning machines including cleaning machines that have one or more of a sweeper, a burnisher and/or a scrubber, as one skilled in the art will appreciate.

Figure 6:
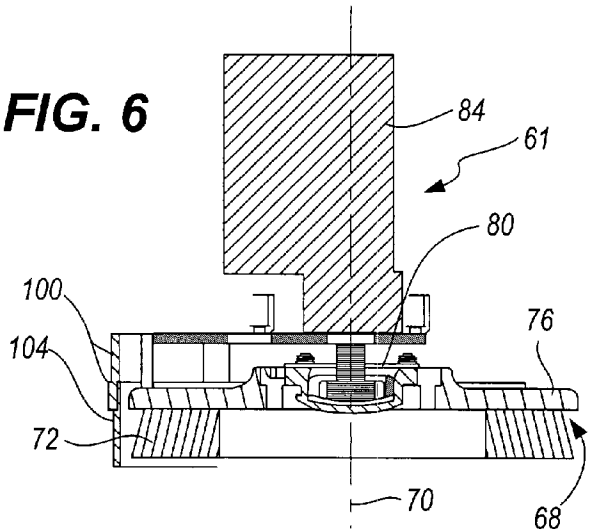
FIG. 6 shows a partial cross section of the scrubbing assembly 30 of FIG. 5, wherein the cross section is taken through the cutting plane identified by "A" in FIG. 5.

With reference to FIGS. 4–7, one embodiment of a scrubbing assembly 30 that can be joined to the cleaning machine body 24 is next described. In this embodiment, the scrubbing assembly 30 includes a pair of scrubber subassemblies 61 having a first scrubbing brush 64 and a second scrubbing brush 68, respectively, and having a combined frame assembly 69. Each of the two scrubbing brushes 64, 68 is essentially disk-shaped with an outer perimeter or circumference. When activated or energized, each of the two brushes 64,68 rotates about its own central, vertical axis 70 (one of which is shown in FIG. 6).

Figure 5:
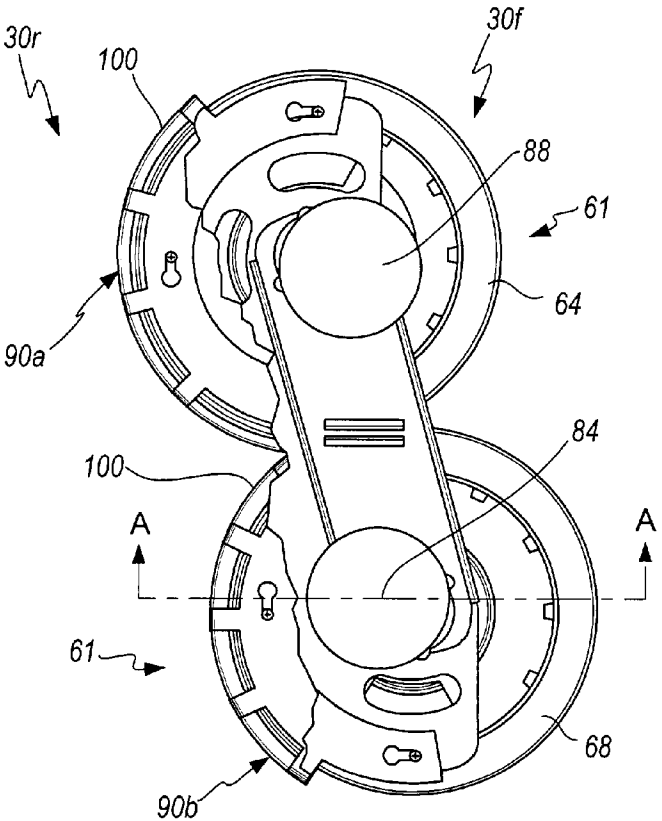
FIG. 5 is a plan view of an alternative embodiment of a scrubbing assembly 30 according to the present invention.

Referring to FIGS. 5, 6 and 7, FIG. 5 shows a plan view of the scrubber subassemblies 61 and the sectioning plane, identified by "A" in FIG. 5, shows where the cross section illustrated in FIGS. 6 and 7 is located.

Figure 4:
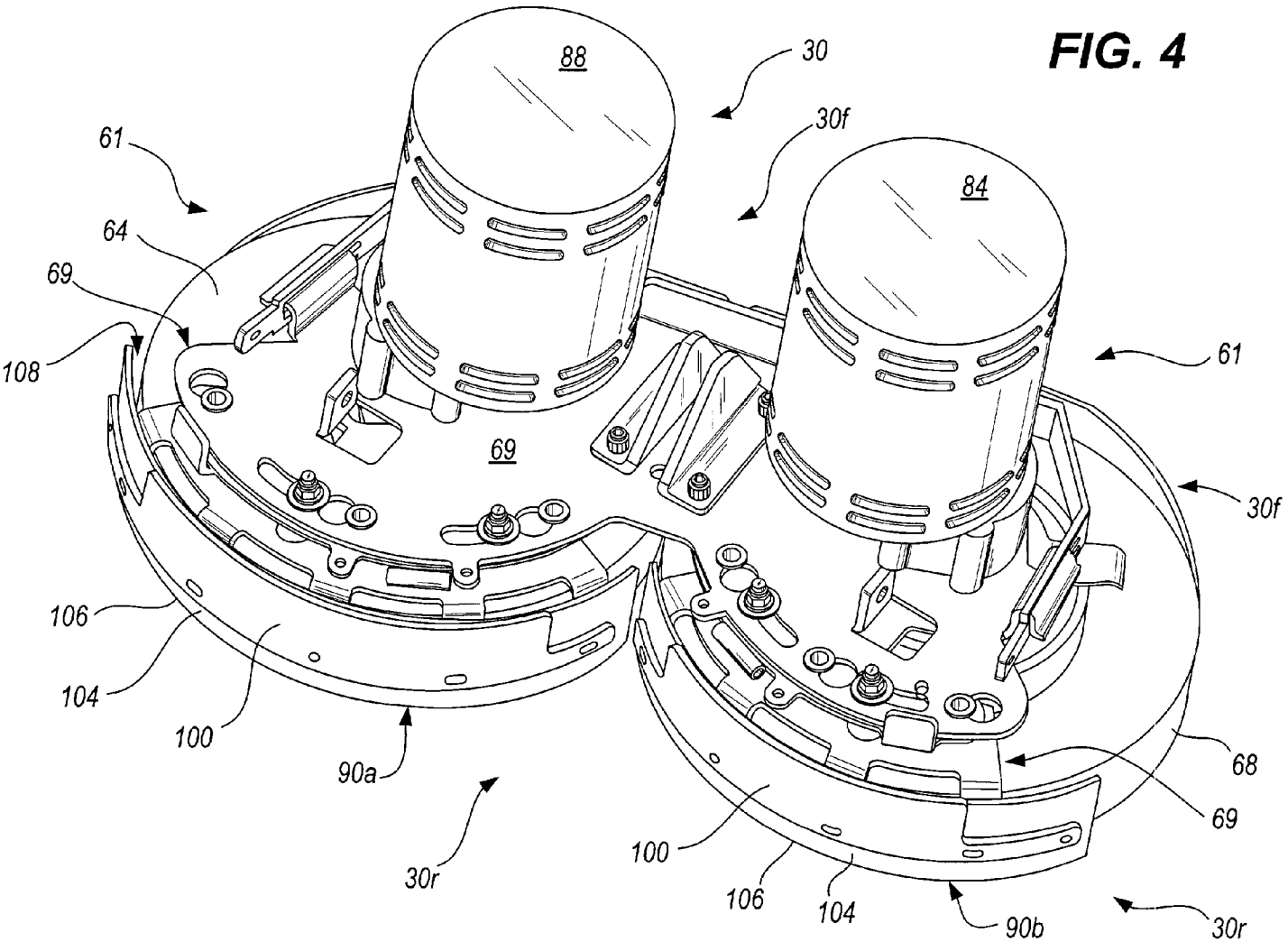
FIG. 4 is a top perspective view of an embodiment of a scrubbing assembly 30 according to the present invention.

Accordingly, FIGS. 6 and 7 show a depiction in more detail directed to the cross section of the second scrubbing brush 68. The second scrubbing brush 68 includes a number of scrubbing bristles 72 (FIG. 7) attached to a head or base member 76. As seen in FIG. 6, the base member 76 is formed with a recessed area at about its mid-portion to receive a driver element 80 that can be caused to rotate using a second scrubbing brush motor 84. Note that a first scrubbing brush motor 88 is illustrated in FIGS. 4 and 5 for similarly causing the first scrubbing brush 64 to rotate when the motor 88 is powered on.

A key component of the present invention is one or more barrier or blocking units, each of which has a shape that generally follows the outer circumference of a corresponding scrubbing brush, and wherein each barrier tends to confine the cleaning solution so that it stays under or near the corresponding scrubbing brush for the barrier. In one preferred embodiment, each such barrier is attached to the frame assembly 69 (FIG. 4) by attachment components such as rivets, bolts, welds, clamps, etc. However, other barrier attachment sites and mechanisms are within the scope of the invention. Moreover, in the embodiment having two scrubbing brushes 64, 68 (e.g., FIG. 4), there are two such barriers 90*a*, 90*b*. That is, a barrier for each of the two scrubber subassemblies 61.

Each such barrier 90*a* and/or 90*b* (and/or additional barriers) may be substantially identical in terms of structure and operation. Accordingly, even though some of the following descriptions may describe only one of a plurality of barriers (e.g., one of the two barriers 90*a*, 90*b* of FIG. 4), in terms of structure and operation, it is to be understood that such a description applies to each such barrier if there is more than one barrier. Referring to each of the two barriers 90*a*, 90*b* of FIG. 4, each barrier is joined to the scrubbing assembly 30, and in particular, to a respective one of the scrubber subassemblies 61 (and more particularly to the frame assembly 69) using, e.g., fasteners, rivets, slots, openings and the like. In a preferred embodiment, each of the two barriers 90*a*, 90*b* is comprised of a bracket 100 and a relatively rigid extender member 104 made of rubber (more generally an elastomeric) or the like. The extender member 104 of each of the barriers 90*a*, 90*b* can be defined as including a bottom edge 106 that continuously contacts the floor surface being cleaned during the cleaning process or operation of the machine 20. Each barrier 90*a*, 90*b* is located generally, at least, at the rear of the scrubbing assembly 30 (i.e., generally, the portion of the scrubbing assembly that trails the scrubbing brush(es) 64 and 68) during forward motion of the machine 20). Moreover, it is preferred that each such barrier follow a contour or profile of the corresponding scrubbing brush about which the barrier at least partially surrounds. In particular, such a barrier may be shaped so that at least the bottom edge 106 of the barrier is coincident with an offset profile of the perimeter of the corresponding scrubbing brush, wherein this offset is from this scrubbing brush's floor contacting perimeter, and is approximately in the range of about one to about four inches from this perimeter. However, smaller offsets are also within the scope of the invention, such as, offsets within the range of ½ to one inch. Additionally, note that each such barrier follows its corresponding scrubbing brush's perimeter for at least most (if not the entire) rearward portion of the corresponding scrubbing brush. More specifically, each such barrier follows an offset contour of its corresponding scrubbing brush for at least approximately 120° of angular extent about the rotational center of the corresponding scrubbing brush. Based on this rearward location of the barrier(s), together with its design or construction, the cleaning solution or other liquid used in scrubbing the floor surface is captured or trapped in the retention area 108, at least for a relatively longer period of time in comparison with scrubbing assemblies that do not have one or more barriers 90*a*, 90*b*, in order that the cleaning material can be used for a longer time by the scrubbing brush(es) having the barrier associated therewith. More generally, each such barrier can be described as not exceeding a predetermined offset from a corresponding one of the scrubbing brushes for at least most of the width (e.g., diameter) of this corresponding scrubbing brush when the machine 20 is operatively moving in a forward direction and cleaning the floor surface 31.

Additionally, note that one embodiment may include a single unified barrier that follows an offset from each of a plurality of scrubbing brushes. Thus, e.g., in such an embodiment, the barriers 90*a* and 90*b* of FIG. 4 may be combined into a single unified barrier, wherein the adjacent ends of the barriers 90*a* and 90*b* that are generally between the scrubbing brushes 64 and 68 are attached to one another.

It is an aspect of the machine 20 that the cleaning solution or other floor surface application materials or substances can be characterized as being held, at least for some time interval, in a the retention area 108 (FIGS. 4, 9 and 11) at those portions of the scrubbing brushes 64, 68 which are then adjacent to the rear 30*r* of the scrubbing assembly 30. In particular, the retention area 108 may be within two inches of each scrubbing brush, and preferably within 1.5 inches of each scrubbing brush, and more preferably within one inch of each scrubbing brush. Moreover, during rotation of, e.g., the first scrubbing brush 64, the materials or solutions, including, e.g., the cleaning solution in the retention area 108, are caused to move in a direction from the rear 30*r* to the front 30*f* of the scrubbing assembly 30. In the embodiment in which there are two scrubbing brushes 64, 68, rotation of the scrubbing brushes 64, 68 causes at least some of such materials, including liquids, to move forwardly past and between the peripheral circumferential portions of the scrubbing brushes 64, 68 that are adjacent to each other. In any case, such a liquid surface application substance or solution, that is retained in the retention area 108 for a relatively short period of time adjacent the scrubbing brushes, is caused to move towards the front 30*f* of the scrubbing assembly 30 and escape from the peripheral or circumferential portions of the scrubbing brushes 64, 68 that are not bounded by the barriers 90*a*, 90*b* since these barriers do not extend about the entire perimeter or all circumferential portions of either the first and second scrubbing brushes 64, 68. Moreover, note that the lower portion 33 substantially prevents the surface application substance or solution from spraying out the front of the machine 20 in the embodiments of the invention wherein the barrier(s) (e.g., 90*a* and 90*b*) do not completely surround the front of the scrubbing brushes. Moreover, the lower portion 33 is generally further from the scrubbing brush(es) than the barrier(s). In particular, where the lower portion 33 and a barrier overlap radially from the center of a scrubbing brush, the barrier overlap is closer to the scrubbing brush than the splash guard 33.

Since each of the two barriers 90*a*, 90*b* may be configured to correspond or match the disk circular shape of each of the scrubbing brushes 64, 68, each barrier 90*a*, 90*b* may be arcuate-shaped and is located a desired radial distance outwardly from the circumferential or peripheral portions of its respective scrubbing brush 64, 68 (e.g., such radial distance being less than two inches, and preferably less than one inch). The arcuate length or perimeter of each arcuate-shaped barrier 90*a*, 90*b* is less than that of the perimeter or circumference of its respective scrubbing brush 64, 68. In one embodiment, the perimeter of such a barrier, particularly the extender member 104, can be characterized in terms of its arcuate extent. Specifically, the actuate extent defines an arc of at least about 90° about the corresponding scrubbing brush, and generally no greater than about 270°. Hence, each barrier extends radially outwardly about the circumference or perimeter of its associated scrubbing brush generally no greater than about 270°.

With respect to the positioning of the barrier relative to a scrubbing brush, it is preferred that the radial distance between the inner surface of the extender member 104 and the closest bristle 72 portion of the scrubbing brush being be less than 2 inches, more preferably less than about 1.5 inches and most preferably less than about 1 inch. This desired radial distance ensures or facilitates the desired retention of cleaning solution or other liquid surface application substance relative to the scrubbing brush bristles 72. It is also preferred that each barrier be fixedly held to the scrubbing assembly 30 so that there is no relative movement therebetween, particularly that there be no pivotal movement between each of the barriers and the scrubbing assembly 30, e.g., about an axis of rotation of a scrubbing brush.

Figure 8:
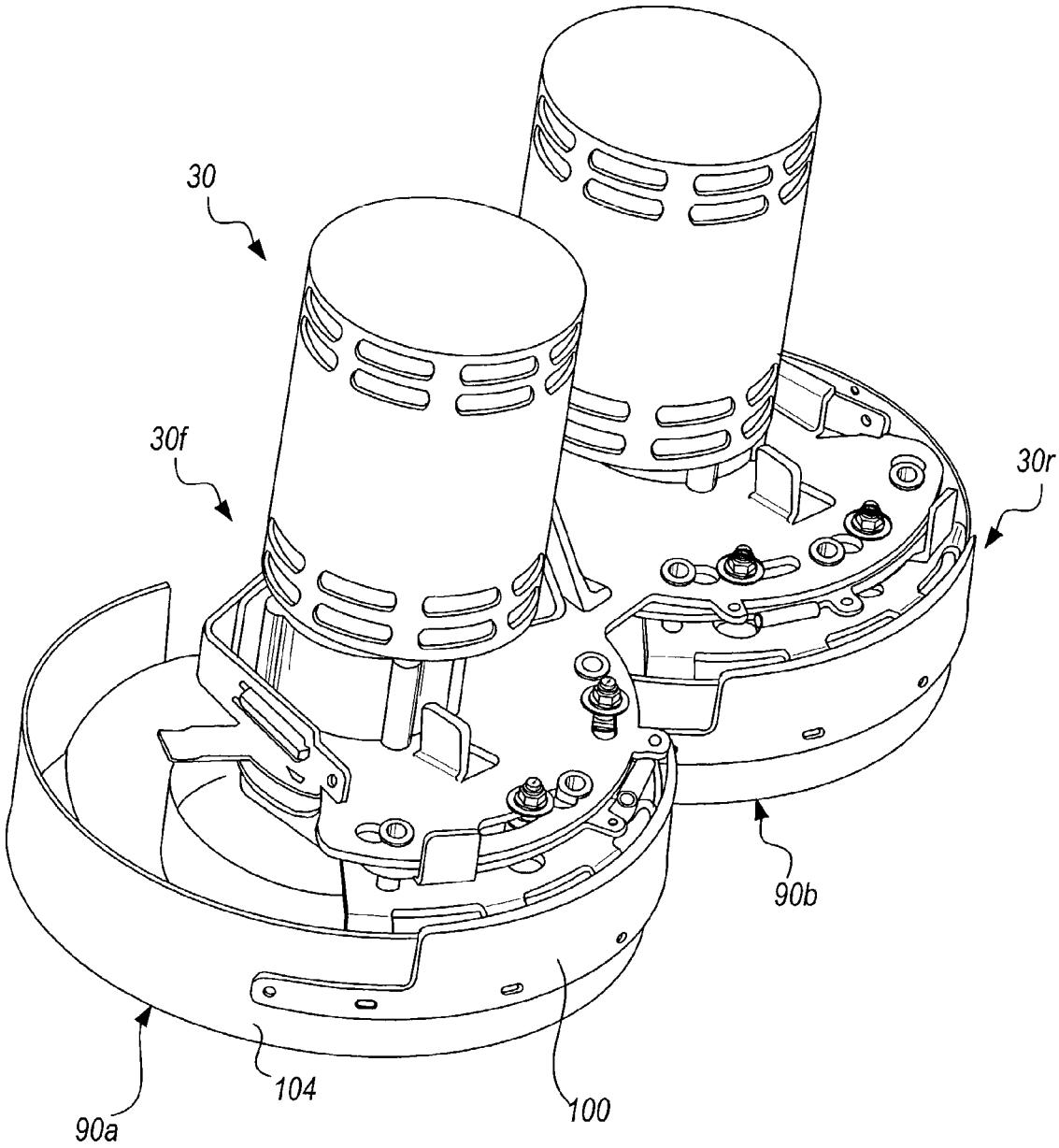
FIG. 8 is a top perspective view of another embodiment of the scrubbing assembly 30 according to the present invention.
Figure 9:
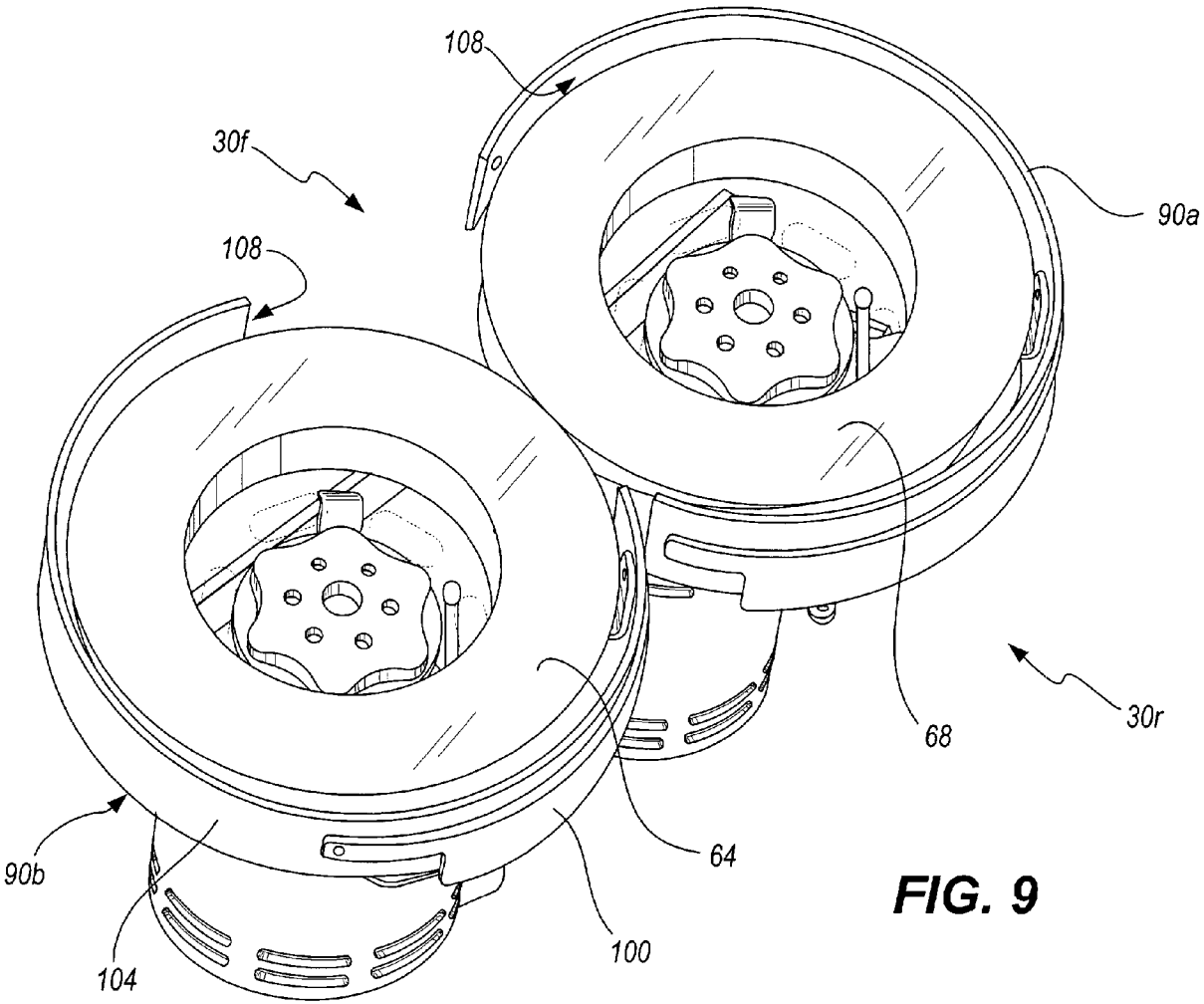
FIG. 9 is a bottom perspective view of the scrubbing assembly 30 of FIG. 8.

With reference to FIGS. 8 and 9, an embodiment of the barriers 90*a* and 90*b* is illustrated in which each of these barriers 90 has a perimeter or arcuate shape that extends for about 270° and has, or is at least close to, the desired maximum arc for controlling the liquid substance or solution within the scrubbing assembly 30, while allowing a sufficient open area for materials including the liquid solution to escape from the scrubbing assembly 30 at its front 30*f*.

In yet another embodiment, at least the extender member 104 could extend a complete 360° radially outwardly of and surrounding a scrubbing brush. According to this embodiment, a slot, notch or other open area would be formed in the extender member 104 to allow for the escape of the surface application substance or solution (and, e.g., surface materials suspended and/or dissolved therein) at the front 30*f* of the scrubbing assembly 30. This open area could be formed by providing the extender member 104 with at least two different heights. The first height of the extender member 104 that includes portions adjacent to the rear 30*r* of the scrubbing assembly 30 could be greater than the height of the extender member 104 at the front 30*f* of the scrubbing assembly 24, 30. The reduced height defines a space or gap at the bottom of the extender member 104 so that it does not contact the floor surface and thereby allows the surface application substance or solution to escape.

In still another embodiment, the height of the extender member 104 could be the same throughout but still a space or gap is defined at its front 30*f* to enable liquid and other materials to exit the scrubbing assembly 30. In one embodiment, the open area defined by the space between the floor surface 31 and the bottom edge 106 of the extender member 104 has an area comparable to the area in the embodiment in which the extender member terminates after a desired number of degrees, such as 270°.

Figure 10:
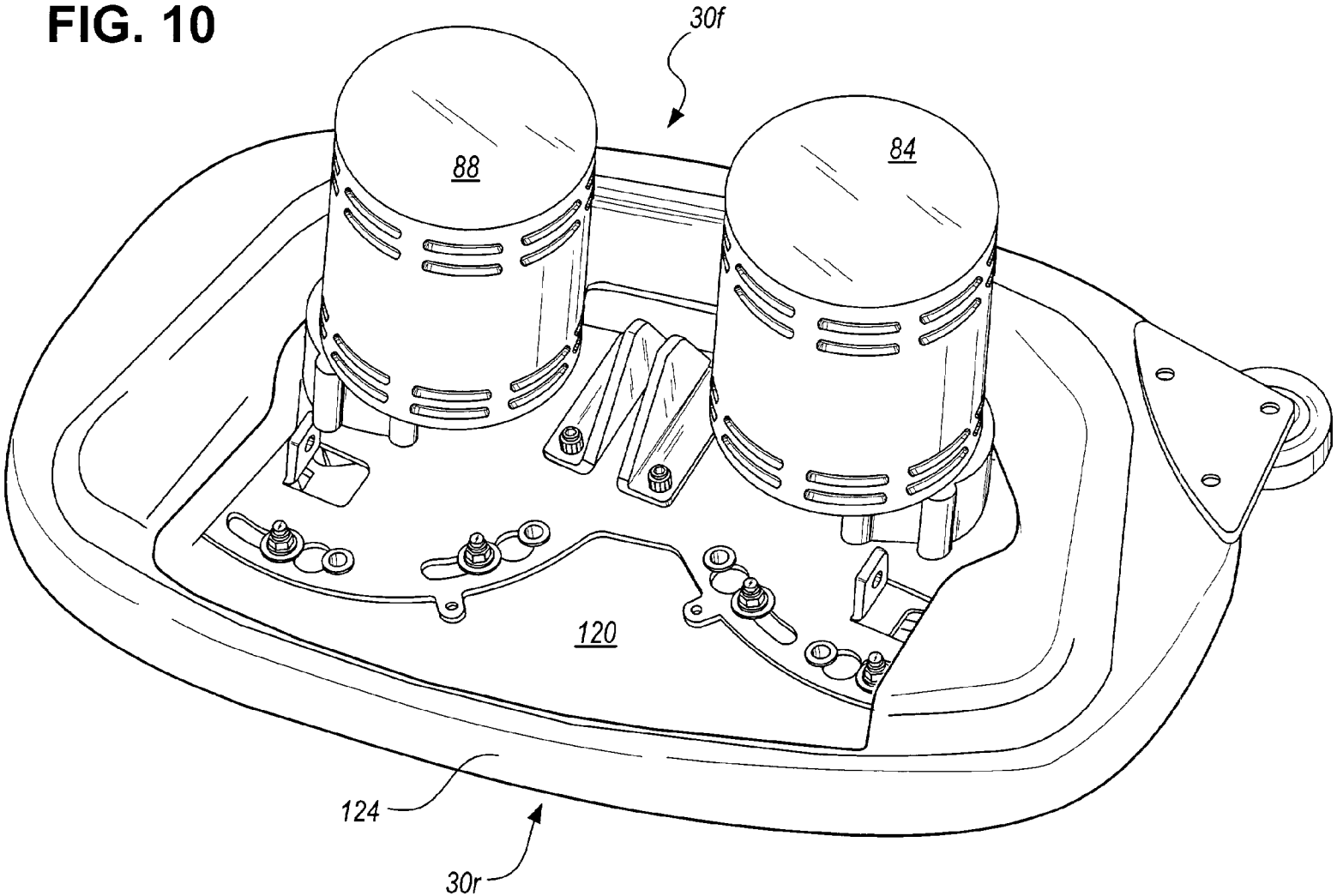
FIG. 10 is a top perspective view of an embodiment of the scrubbing assembly 30 with a hood 120 providing a splash guard between the scrubbing brushes 64 and 68 (e.g., FIG. 9) and the motors 84 and 88.
Figure 11:
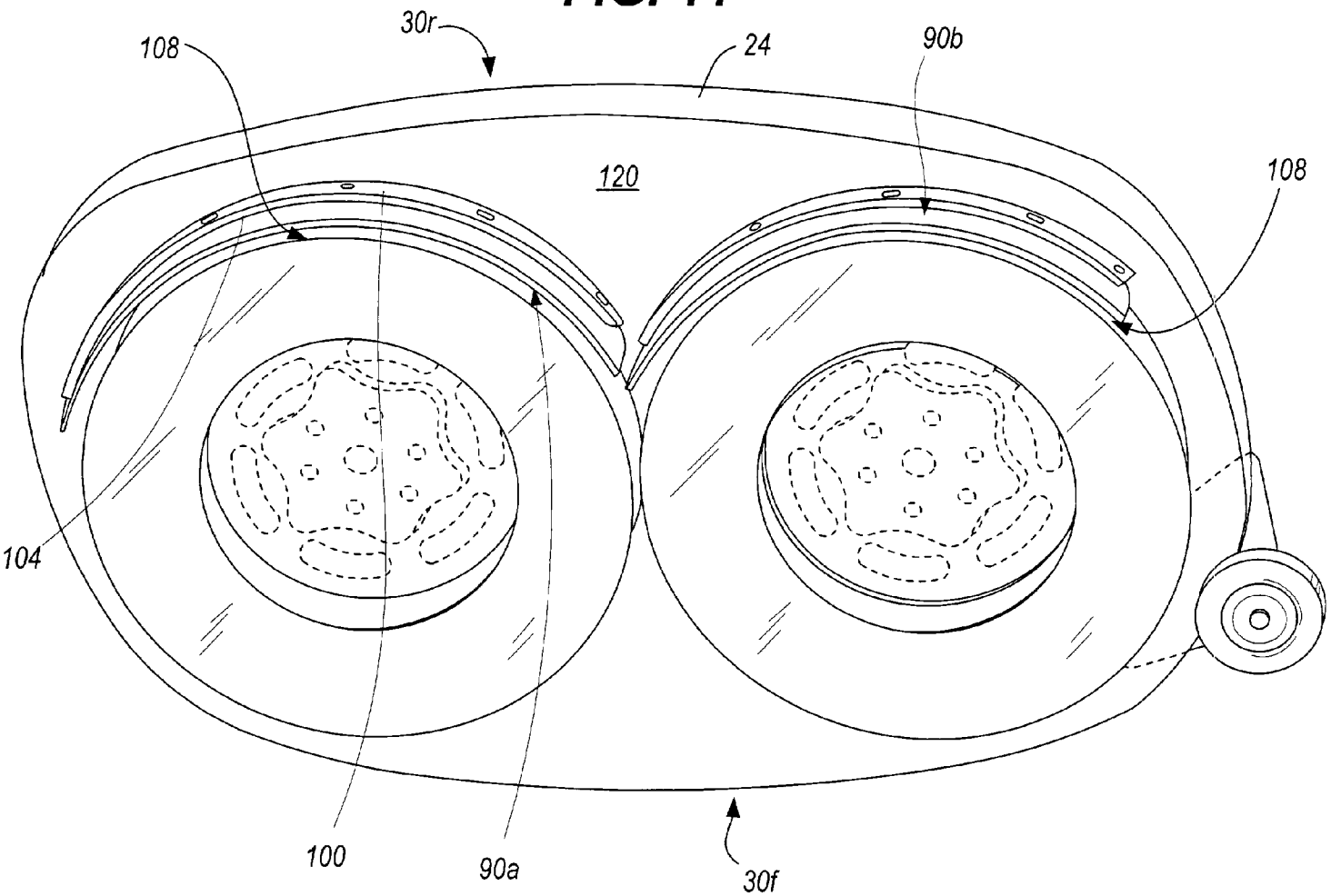
FIG. 11 is a bottom perspective view of the scrubbing assembly 30 and hood 120 of FIG. 10.

With reference to FIGS. 10 and 11, a further preferred embodiment of the scrubbing assembly 30 is illustrated that has essentially the same features and construction of FIGS. 1–7, for example. Additionally, this embodiment includes a skirt hood or splash guard 120 which serves as an internal splash guard for preventing airborne particles and/or cleaning application substances or solutions from interfering with the operation of the scrubbing brush motor(s), e.g., 84 and 88. The skirt hood 120 may include an downwardly directed skirt 124 that is located outwardly of each barrier 90*a* and 90*b*. In one embodiment, the shortest distance between any portion of a barrier 90*a* or 90*b* and the skirt 124 is greater than any radial distance between each such barrier 90 and its associated scrubbing brush. Like splash guards or skirts used in conventional designs, the skirt 120 is useful in preventing or otherwise controlling liquid spattering or splashing of the surface application substance or solution that typically occurs during the a scrubbing process.

The foregoing discussion of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiments described hereinabove are further intended to explain the best mode presently known of practicing the invention and to enable others skilled in the art to utilize the invention as such, or in other embodiments, and with the various modifications required by their particular application or uses of the invention.

What is claimed is:

1. A floor cleaning machine for cleaning a floor surface, comprising:

a body;

a scrubbing assembly including at least a first scrubbing brush and being joined to said body, said scrubbing assembly having a front and a rear and said front leading said rear when the floor cleaning machine is moving in a forward direction, said first scrubbing brush has a circumference having a circumferential portion that is between about 90° and about 270°;

at least a first barrier fixedly attached to, including non-pivotal relative to, said scrubbing assembly which substantially prevents escape of liquid from said rear of said scrubbing assembly, wherein the liquid moves in a direction from said rear to said front of said scrubbing assembly, said first barrier also including an extender member having a bottom edge with a length, said bottom edge being disposed radially outwardly of said first scrubbing brush circumferential portion and wherein said bottom edge extends in continuous contact with the floor surface along said length thereof during cleaning of the floor surface; and a skirt located outwardly of said first barrier and with the distance between said first barrier and said skirt being greater than the distance between said first scrubbing brush and said first barrier.

2. The floor cleaning machine, as claimed in claim 1, wherein:

said first scrubbing brush has a perimeter and said first barrier has a perimeter with a first height that remains substantially the same throughout and said first barrier perimeter is less than said perimeter of said first scrubbing brush.

3. The floor cleaning machine, as claimed in claim 1, wherein:

said bottom edge is located radially outwardly a distance less than about four inches from said circumferential portion of said first scrubbing brush.

4. The floor cleaning machine, as claimed in claim 1, further including:

a second scrubbing brush adjacent to said first scrubbing brush; and a second barrier attached to said scrubbing assembly, said second barrier substantially preventing liquid from escaping said rear of said scrubbing assembly and the liquid moving in a direction from said rear to said front of said scrubbing assembly between said first and second scrubbing brushes.

5. The floor cleaning machine, as claimed in claim 1, wherein:

said body has upper portions that define a cavity and said cavity has a size that holds at least a first item related to cleaning.

6. The floor cleaning machine, as claimed in claim 5, further including:

a containment structure disposed over at least portions of said cavity.

7. A method for controlling containment of liquid during operation of a floor cleaning machine, comprising:

providing at least a first scrubbing brush that is defined by a circumference having a circumferential portion, said first scrubbing brush being part of a scrubbing assembly having a front and a rear and said scrubbing assembly being joined to a body of said floor cleaning machine;

providing at least a first barrier having an arcuate shape and which is disposed radially outwardly of said circumferential portion, said first barrier having a perimeter in the range of between about 90° and about 270°;

cleaning a floor over which said floor cleaning machine moves while substantially preventing passage of liquid from said rear of said scrubbing assembly using said first barrier while allowing liquid to escape at least said front of said scrubbing assembly; and providing a skirt located outwardly of said first scrubbing brush and said first barrier with the distance between said skirt and said first barrier being greater than the distance between said first barrier and said first scrubbing brush.

8. The method, as claimed in claim 7, wherein:

said first barrier is located a distance less than about four inches from said circumferential portion.

9. The method, as claimed in claim 7, wherein:

said first barrier has a bottom edge with a length and said bottom edge continuously contacts the floor during said cleaning step along all said length.

10. A method, as claimed in claim 7, wherein:

said skirt has a perimeter that surrounds all said first brush.

11. The method, as claimed in claim 7, further including;

providing a second scrubbing brush and a second barrier, said second scrubbing brush defined by a circumference having a circumferential portion with said circumferential portion being less than said circumference, and said second barrier having an arcuate shape and being disposed radially outwardly of said circumferential portion, said second barrier having a perimeter that is less than said circumference of said second scrubbing brush.

12. A floor cleaning machine for cleaning a floor surface, comprising:

a body;

a scrubbing assembly including one or more scrubbing brushes and being joined to said body, said scrubbing assembly having a front and a rear and said front leading said rear when the floor cleaning machine is moving in a forward direction, wherein a movement of said scrubbing brushes contributes to a solution moving in a direction from said rear to said front of said scrubbing assembly;

a splash guard extending substantially about a front portion of said body, said splash guard for reducing an airborne exit of the solution from said body;

one or more barriers adjacent to said scrubbing brushes for substantially preventing escape of the solution from said rear of said scrubbing assembly; and a squeegee assembly spaced from each said barrier, wherein said squeegee assembly extracts the solution from the floor surface;

wherein at least a first portion of one of said barriers is closer to said scrubbing brushes than said splash guard, and wherein at least some portion of one of said barriers is closer to said scrubbing brushes than said squeegee assembly.

13. The floor cleaning machine, as claimed in claim 12, wherein:

at least one of said barriers follows a profile of one of said scrubbing brushes for at least approximately 90° about a rotational center of said at least one scrubbing brush.

14. The floor cleaning machine, as claimed in claim 12, wherein:

each of said one or more barriers is within a predetermined offset from a corresponding one of said scrubbing brushes for at least most of a width of said corresponding scrubbing brush, wherein said offset is in the range of ½ to 4 inches.

15. The floor cleaning machine, as claimed in claim 14 wherein:

said offset provides a retention area for retaining the solution and for moving the solution toward the front of said scrubbing assembly.

16. The floor cleaning machine, as claimed in claim 12, wherein:

said body includes upper portions that define at least one cavity with a size for holding one or more objects related to cleaning.

17. The floor cleaning machine, as claimed in claim 16, wherein:

said upper portions are defined as including a total outer surface area and said at least one cavity has an outer surface area that is at least about 10 percent of said total outer surface area.

18. The floor cleaning machine, as claimed in claim 16, further including:

at least one containment structure disposed over at least portions of said at least one cavity.

19. The floor cleaning machine, as claimed in claim 16, further including:

at least one recess formed in said upper portions for holding a liquid containing object.

* * * * *